US007694358B2

(12) United States Patent
Stimpson

(10) Patent No.: US 7,694,358 B2
(45) Date of Patent: Apr. 13, 2010

(54) SHOWER TRAY

(75) Inventor: Robert William Stimpson, British Isles (GB)

(73) Assignee: DLP Limited, Braddan (IM)

( * ) Notice: Subject to any disclaimer, the term of this patent is extended or adjusted under 35 U.S.C. 154(b) by 539 days.

(21) Appl. No.: 10/958,619

(22) Filed: Oct. 6, 2004

(65) Prior Publication Data

US 2005/0081290 A1 Apr. 21, 2005

(30) Foreign Application Priority Data

Oct. 16, 2003 (GB) ..... 0324219.5

(51) Int. Cl.
*A47K 3/22* (2006.01)
*A47K 3/34* (2006.01)
*A47K 3/36* (2006.01)

(52) U.S. Cl. ..... 4/613; 4/612; 4/604

(58) Field of Classification Search ..... 4/538, 4/546, 555, 592, 593, 597, 604, 605, 609, 4/610, 612, 613; 52/34
See application file for complete search history.

(56) References Cited

U.S. PATENT DOCUMENTS

| | | | | |
|---|---|---|---|---|
| 3,462,771 | A * | 8/1969 | Moretti | 4/613 |
| 4,577,450 | A * | 3/1986 | Large | 52/787.12 |
| 5,083,330 | A * | 1/1992 | Dusar | 4/610 |
| 5,299,330 | A | 4/1994 | Moore | |

FOREIGN PATENT DOCUMENTS

| | | |
|---|---|---|
| DE | 298 19 329 | 4/2000 |
| EP | 1181883 A1 | 2/2002 |
| GB | 2 297 904 | 8/1996 |
| GB | 2301030 | 11/1996 |

* cited by examiner

*Primary Examiner*—Tuan N Nguyen
(74) *Attorney, Agent, or Firm*—Young & Thompson

(57) ABSTRACT

A shower tray has a trough along one or more sides of the tray and structure for clamping flexible floor covering material and/or a flexible edge of a ramp device in the trough(s). The clamping structure may comprise one or more elongate clamping elements and securement for fixing the clamping element(s) in the trough(s).

19 Claims, 12 Drawing Sheets

SHOWER TRAY

BACKGROUND OF THE INVENTION

1. Field of the Invention

This invention relates to a shower tray and more particularly, but not exclusively to a low level shower tray.

2. Description of the Related Art

Special low level shower trays are produced enabling the handicapped, infirm or disabled to access showering facilities whilst seated in a wheelchair. The wheelchair user is currently presented with a number of different access methods depending on the type of low-level access shower tray selected and installed within the bathing area.

In one example of current state of the art, the shower tray may be located below the floor surface as a wet floor former, which is then covered with a waterproof covering running down the sloping former to the waste location. This is exemplified by the current applicants "Tuff Form" wet floor former. This type of installation provides the best surface for access presented to the wheelchair user since it creates a generally smooth and uninterrupted flooring surface over the entire bathing area.

In another example of the current state of the art, the shower tray may be located above and in contact with the floor surface, with sloping access ramps being provided to allow the wheelchair user access to the showering area from the surrounding floor. This is exemplified by the current applicants "Multispec" shower tray. This type of installation provides a raised showering area above the surrounding room floor, requiring greater effort by the wheelchair user to access the showering area, but may be necessary due to constructional constraints created by the nature of the flooring structure.

In yet a further example of the current state of the art, the shower tray may be located primarily within the floor but raised sufficiently only to expose a perimeter rim, typically no more than 3 to 5 mm in height, under which the floor covering is located and sealed and over which the wheelchair user can manoeuvre to access the showering area. This is exemplified by the current applicants "Low Profile" shower tray. Often this type of tray is provided where the floor covering already exists and the this type of tray is installed to minimise the disturbance to the floor at the same time providing the lowest ramp arrangement.

The three aforementioned variations in the current state of the art each require a dedicated design of shower tray which has been specifically designed to suit the differing requirements of each type of installation. This necessitates the manufacturer and installer stocking not only a wide range of sizes to suit individual bathing area requirements, but also a number of differing types of shower tray according to the intended method of installation.

In the examples of current state of the art described above, one of the most difficult requirements of a shower installation to achieve is water-tightness of the flooring. Other manufacturers in the past have attempted to use wide, flat areas of the tray surface on which to bond the flooring (Morton, GB2357034A), or an edge slot (Gontar, GB2301030). In both of these examples the finished edge is difficult to install to leave in a neat tidy and workmanlike manner and at the same time providing a waterproof seal.

Yet another method of attempting to achieve a waterproof seal is exemplified by Sohne (DE 195 41366A1) whereby the entire floor waterproof surface runs under the shower tray and is connected to the waste. The perceived disadvantage of this method is it creates a risk of creating inaccessible pools of stagnant water below the tray, with associated health risks and implications.

The present invention seeks to provide a shower tray device which provides the access and positioning benefits of a wet floor former water seal whilst simultaneously allowing low level shower tray and surface shower tray installation options.

SUMMARY OF THE INVENTION

According to the present invention there is provided a shower tray comprising a trough along one or more sides of the tray and means for clamping flexible floor covering material and/or a flexible edge of a ramp device in the or each trough.

The invention will now be more particularly described, by way of example, with reference to the accompanying drawings.

DESCRIPTION OF THE PREFERRED EMBODIMENTS

Figure 1:
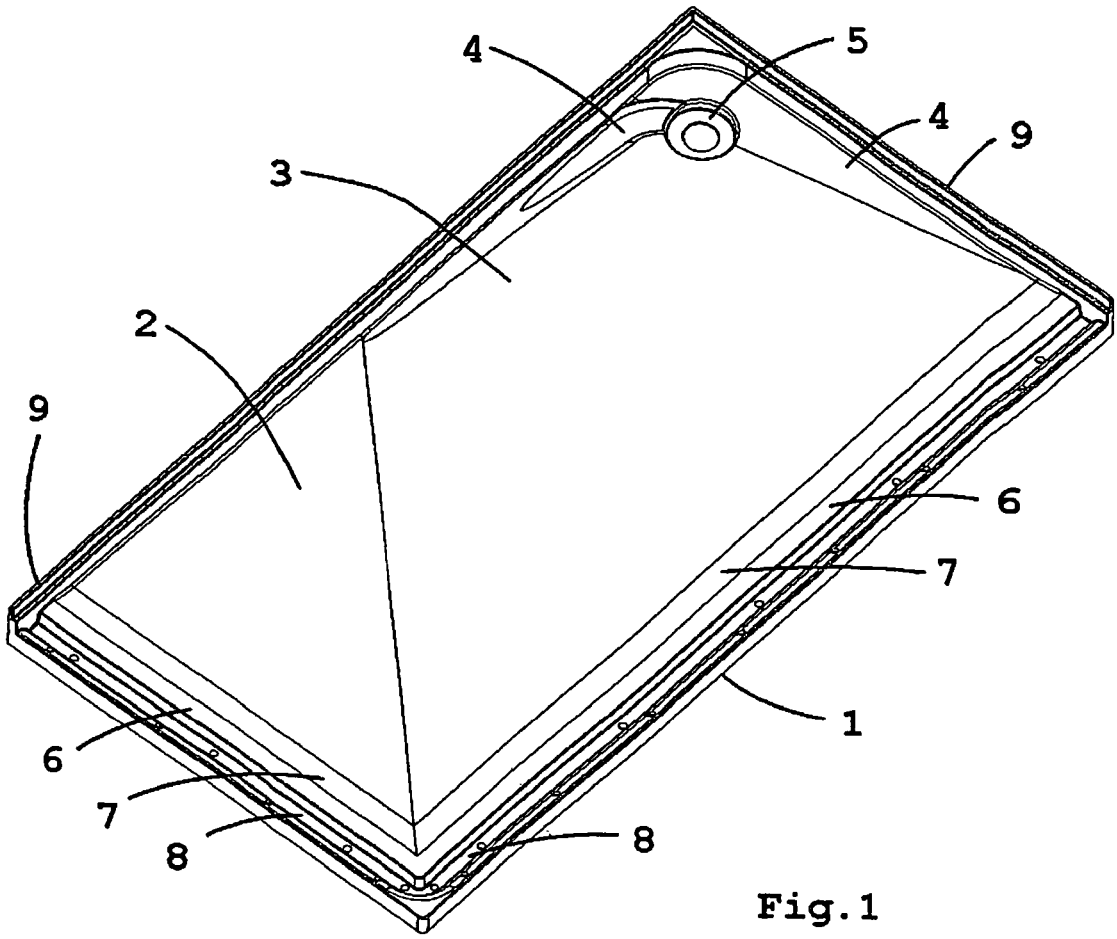
FIG. 1 is an isometric view from above a front corner of one embodiment of the shower tray.

Referring firstly to FIG. 1 there is shown therein a shower tray 1 which provides sloping upper surface facets 2, 3, 4 of varying shapes and slopes combining to direct water which may be impinging upon them (not shown) to the waste 5. Surrounding the sloping upper facets is a horizontal flat surface 6 which is linked to them by interfacing transitional facets 7. The horizontal flat surface 6 provides a surface onto which shower enclosure screens (not shown) may achieve a water resistant seal. External to the flat surface 6 is a particularly shaped trough recess 8 which is shown in this embodiment as bordering the tray on two sides. It is also envisaged that alternative embodiments of the present invention may include similar shower trays comprising other shapes considered as regular or irregular polygons of any number of sides which can reasonably be used within a showering area to fit within the constraints of the building into which it may be installed.

FIG. 1 also shows an embodiment of the present invention which provides a wall tiling upstand 9 on two adjacent sides permitting the shower tray to be positioned against the corner of a room and allowing tiles (not shown) to be fitted in a watertight manner to the tray.

It may clearly be seen that any skilled artisan can develop this description to shower trays which have tiling upstands 9 on any or none of the adjacent sides, and an inversely proportional number of particular troughs 8 around the remaining sides of the particular embodiment of the show tray so created. Likewise, the location of the waste 5 may similarly be positioned in other embodiments of the present invention at locations central to the particular tray considered, or at any offset position anywhere between the tray centre and outer edges thereof.

The material of construction of the preferred embodiment of the shower tray herein described is glass fibre reinforced plastics material, primarily of the closed-mould type where the shower tray device is formed under heat and pressure in a double sided cavity tool. Alternative materials may also be, but not exclusively limited to, metal fabrications or castings, glass and or carbon fibre reinforced plastics materials, resin composites of plastic, timber or other constructional materials which contribute to the structural stiffness and integrity of such a device. Injection and or vacuum assisted moulded (in moulds heated or otherwise) thermoplastic and or thermosetting materials which may or may not be modified with inserted items, fillers, fibres, fabrics and or other reinforcing matter of any material type, may also be applied to create alternative embodiments of the currently described shower tray which may additionally be constructed using hand-lay-up glass reinforced fabric and or random chopped strand fibre materials over a gel-coat applied to a single-sided mould tool with board reinforcement embedded within the glass reinforced plastic materials.

Figure 2:
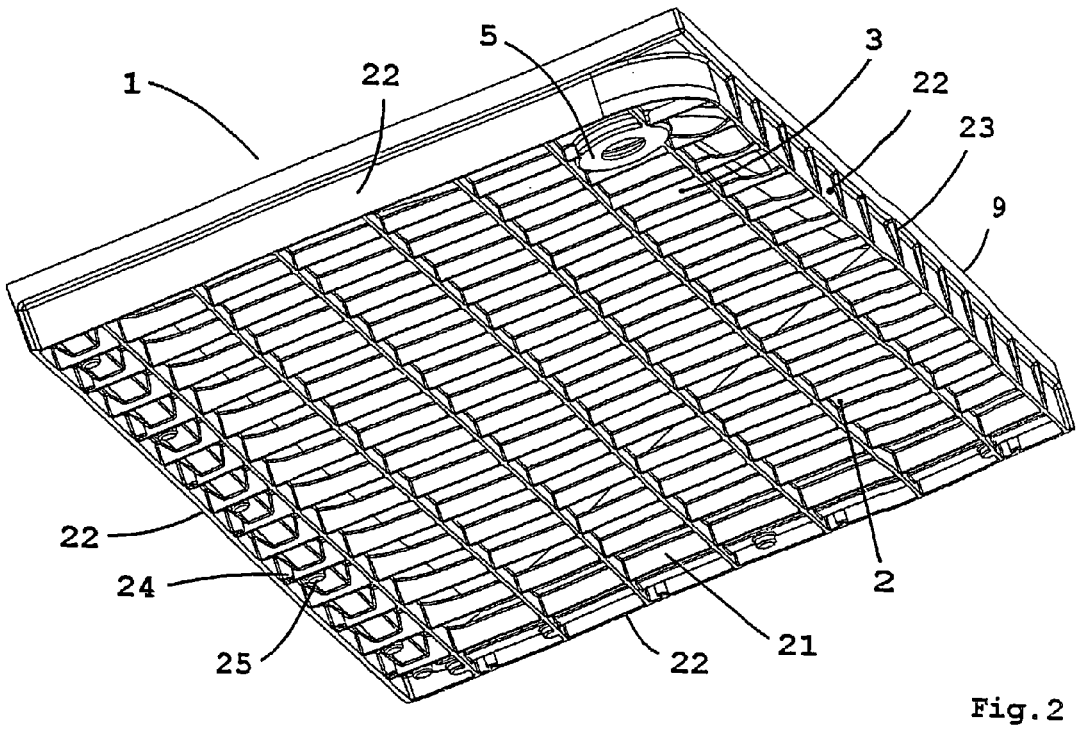
FIG. 2 is an isometric view from below the rear long side of one embodiment of the shower tray.
Figure 3:
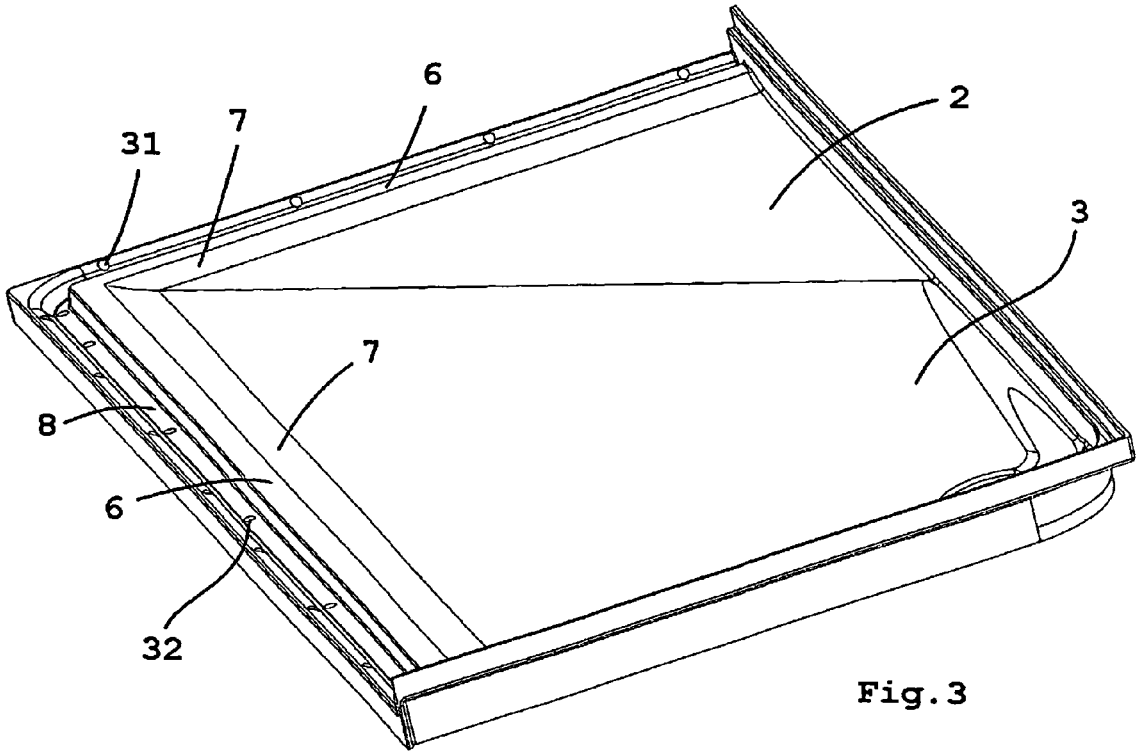
FIG. 3 is an isometric view from above and behind the rear long side of an embodiment of the shower tray.
Figure 4:
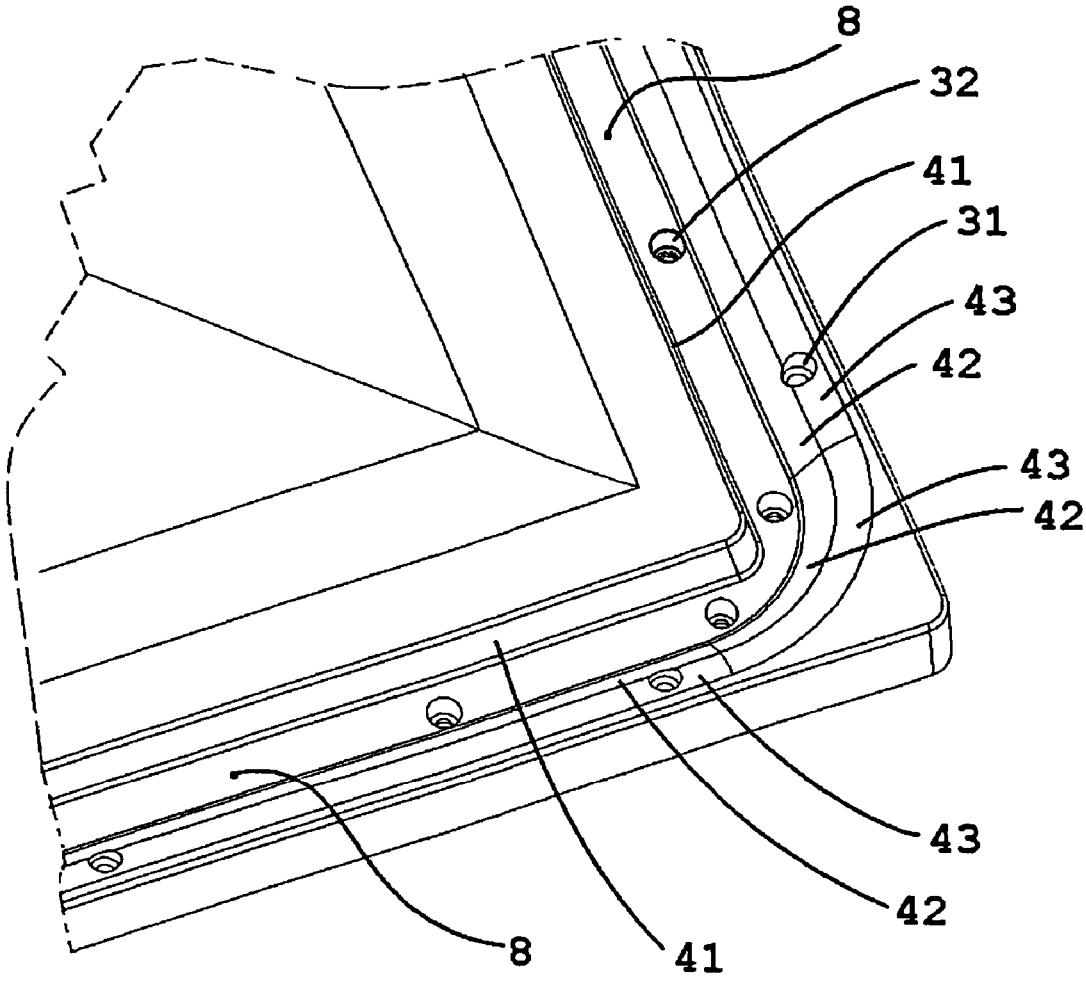
FIG. 4 is an enlarged fragmentary isometric view from above a front corner of one embodiment of the shower tray.

FIG. 2 shows an embodiment of the present invention where the material is of a moulded type which allows a plurality of inner supporting ribs 21 to be provided which support the lower surfaces of the upper surface facets 2, 3. The said supporting ribs may be terminated around the periphery by edge flanges 22. The tiling upstand 9 may also be reinforced where it is connected to the perimeter flange 22 by a plurality of reinforcing ribs 23. The lower surface of the shower tray may also include projecting features for mounting screws 24 and internal fittings 25 as part of the primary shower tray structure 1.

Referring to FIGS. 4, 5*a*, 5*b* and 5*c*, further detailed features of a preferred embodiment of the present design are portrayed. The outer edge particular trough feature 8 comprises an inner face 41 which is substantially but not exactly vertical. On the opposite side of the trough 8 to the inner face 41, is an outer sloping face 42 and an outer blend curved face 43. The inner face and outer sloping face and curved face features are extended around the edges of the shower tray which have a trough feature and are suitably blended into each other in an approximately seamless manner.

Located within the outer sloping face and outer blend radius sections of the shower tray in a plurality of positions may be holes for the heads of fixings 31 which may also be shaped 53, 54 to be suitable for typically a countersunk head wood screw. These holes may be employed in any proportion by an installer attaching the shower tray to the floor at regular or irregular locations around the periphery. Other embodiments may include non-circular or other shapes of recess which may be matched to a particular type or style of fixing which may be employed to attach the shower tray to the floor.

Figure 5A:
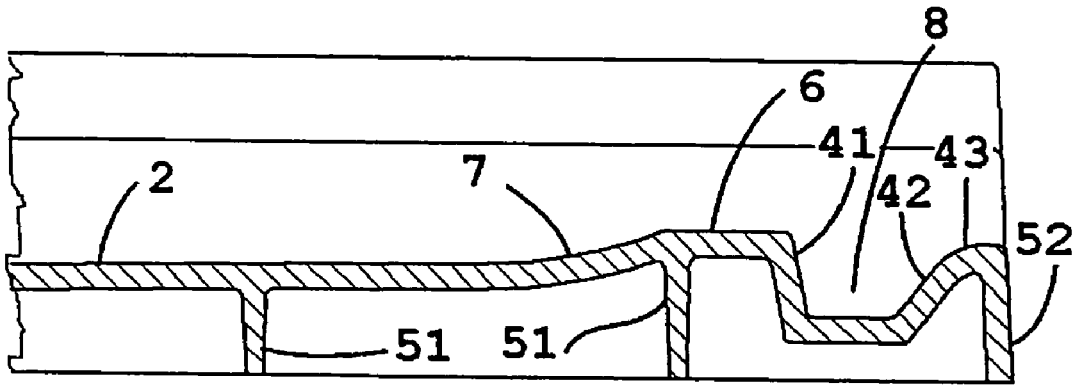
FIG. 5 is a series of three enlarged fragmentary sectional views (5*a*, 5*b* and 5*c*) taken through an embodiment of the shower tray and along three different parallel section planes perpendicular to the peripheral edges.
Figure 5B:
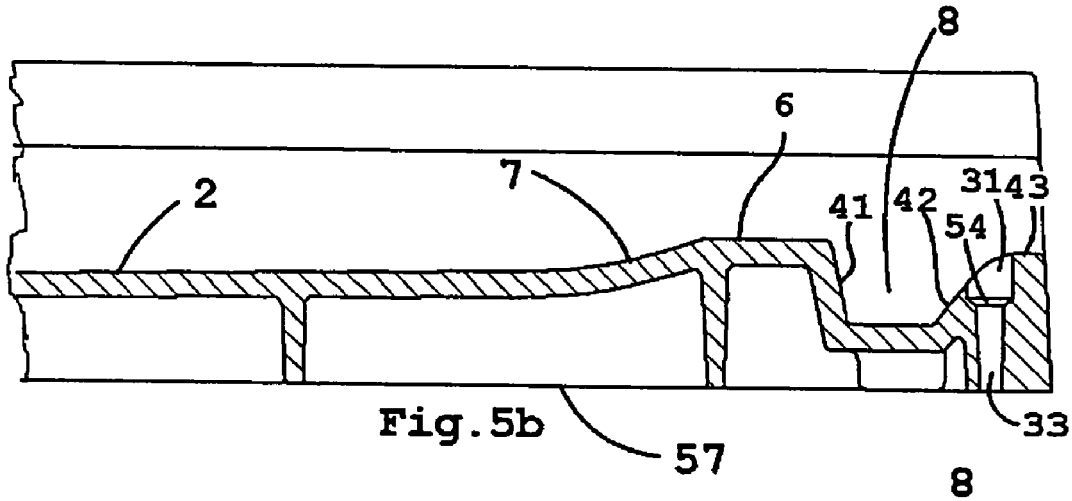
Figure 5C:
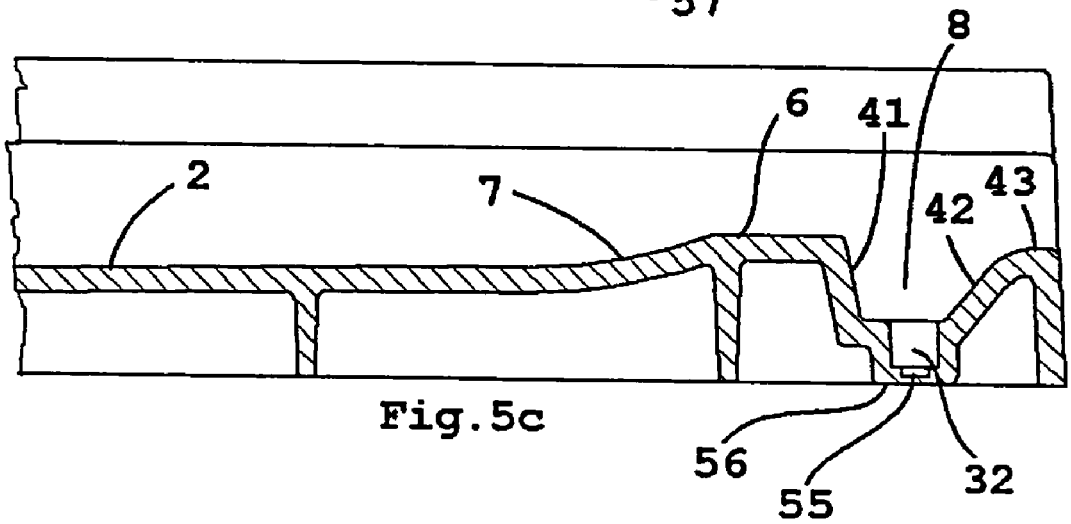

FIG. 5*a* shows in section a sample of the plurality of supporting ribs 51 which are similar in profile to the edge rib 52 and which are level with the lower surface of the tray 57.

In the preferred embodiment of the present invention, the shower tray is moulded to incorporate blind holes or recesses 32 which can accommodate threaded fittings (not shown in this section view), and an optional smaller diameter recess 55 to accommodate any protrusion of the fixing which may be inserted into the threaded fittings located into the blind hole. The external edge of the blind hole recess 55 may be located 56 in a coplanar manner with the base of the shower tray. Alternative embodiments may include solid inserts to accept different types of fixings which perform thread cutting functions into the same locations as those indicated by 32 on the drawings.

Figure 6:
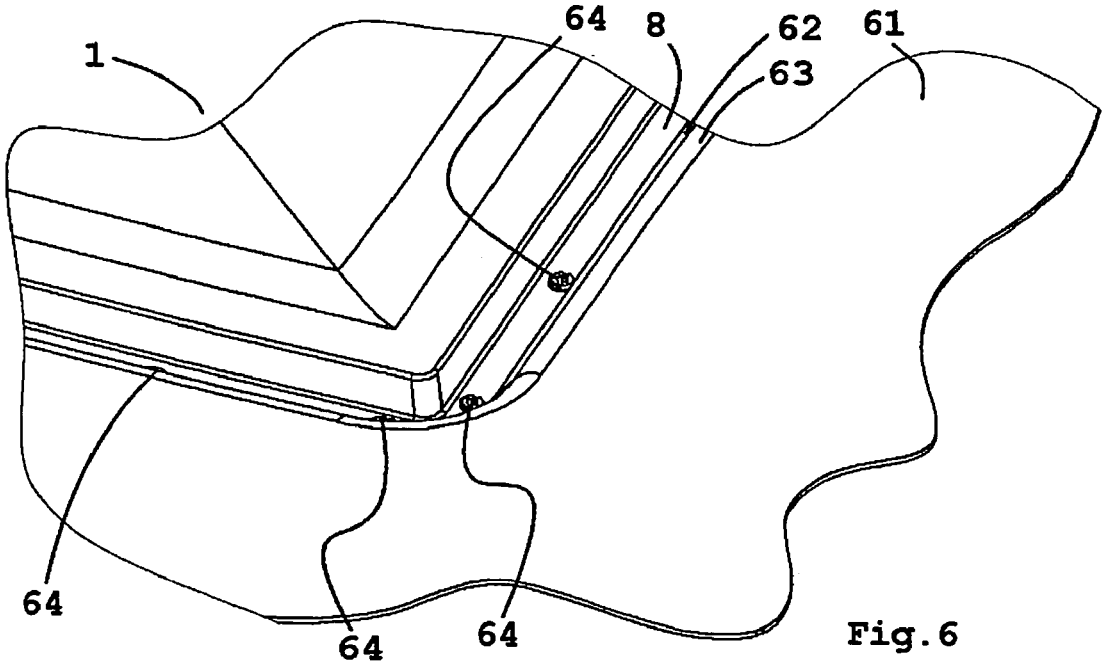
FIG. 6 is an enlarged fragmentary isometric view from above a front corner of one embodiment of the shower tray in a partly assembled state showing the location of surrounding flooring materials.
Figure 7:
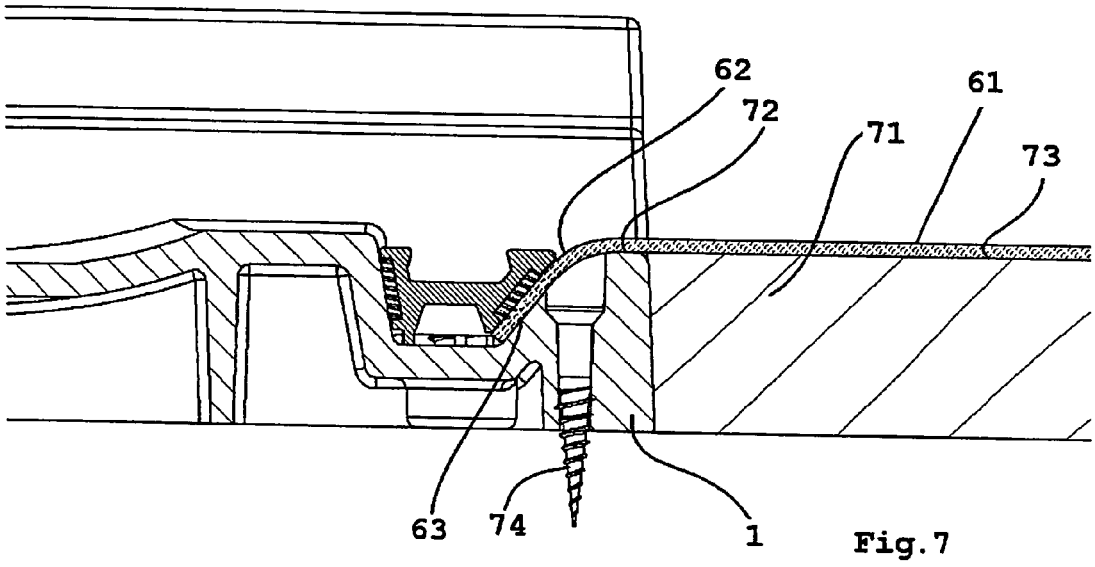
FIG. 7 is an enlarged fragmentary sectional view taken through an embodiment of the shower tray in a different partly assembled state to FIG. 6, the section taken along a plane perpendicular to a peripheral edge of the tray, similar in location to FIG. 5*b*.
Figure 8:
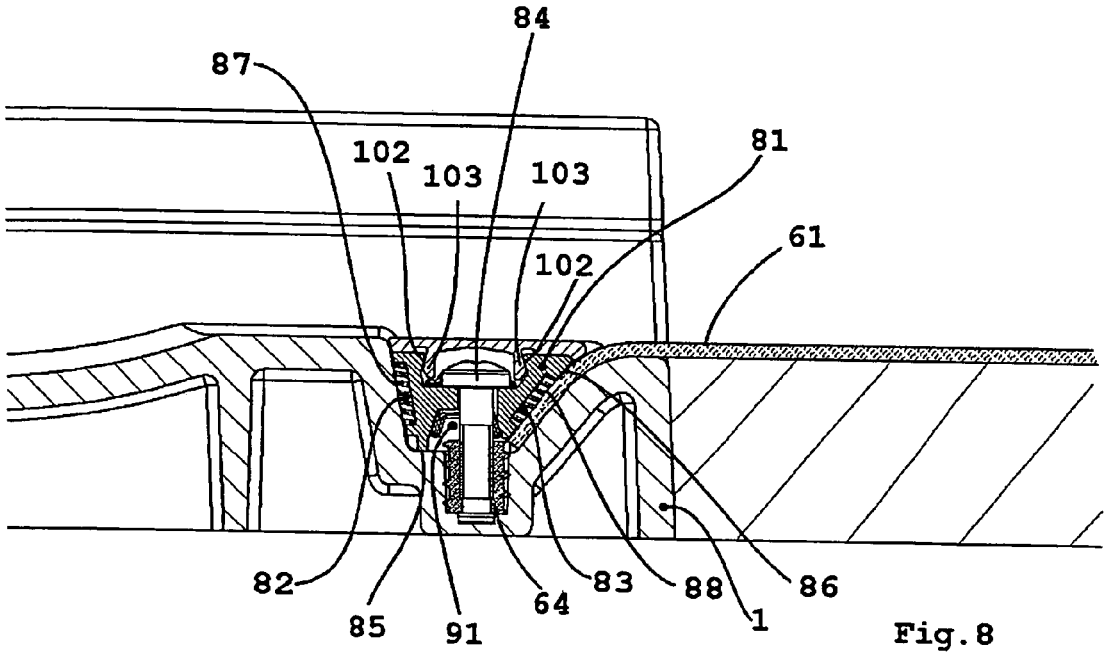
FIG. 8 is an enlarged fragmentary sectional view taken through an embodiment of the shower tray in the same partly assembled state to FIG. 7, the section taken along a plane perpendicular to a peripheral edge of the tray, similar in location to FIG. 5*c*.
Figure 9:
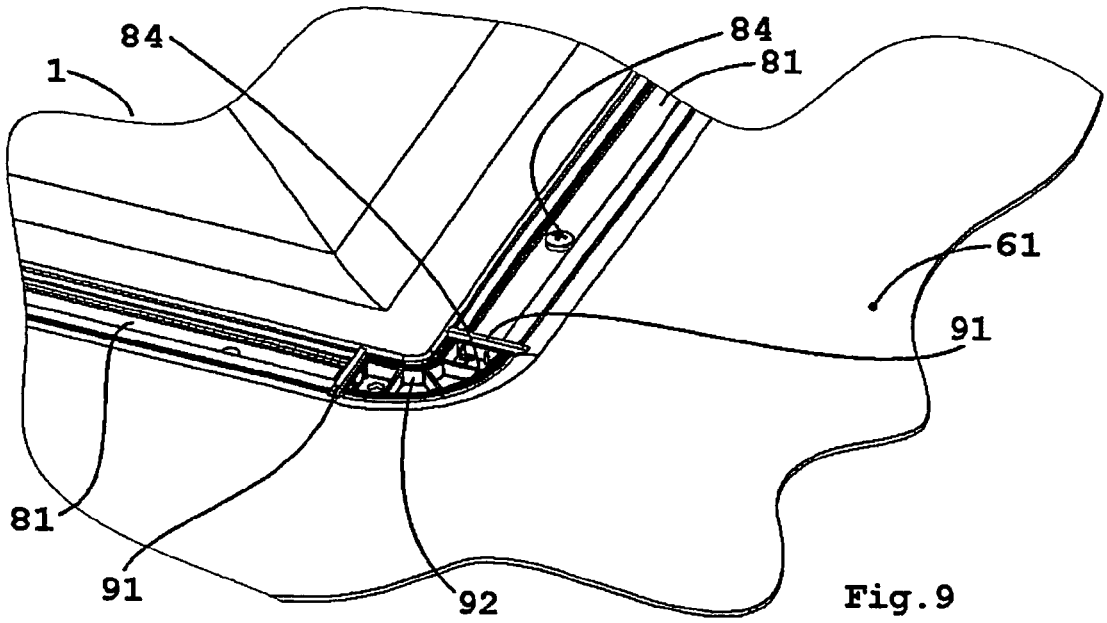
FIG. 9 is an enlarged fragmentary isometric view from above a front corner of one embodiment of the shower tray, from the same viewpoint as FIG. 6, in a partly assembled state different to that of FIG. 6, showing the location of further components and surrounding flooring materials.
Figure 10:
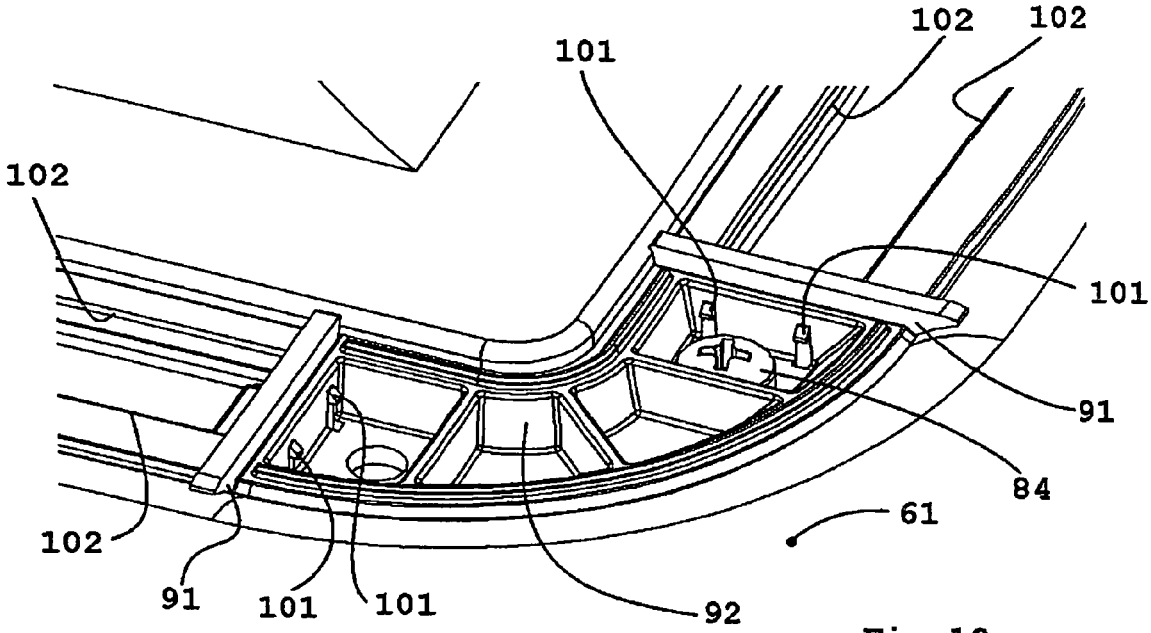
FIG. 10 is a further enlarged fragmentary isometric view showing a small portion of FIG. 9 and permitting the discernment of additional features of the components portrayed therein.
Figure 11:
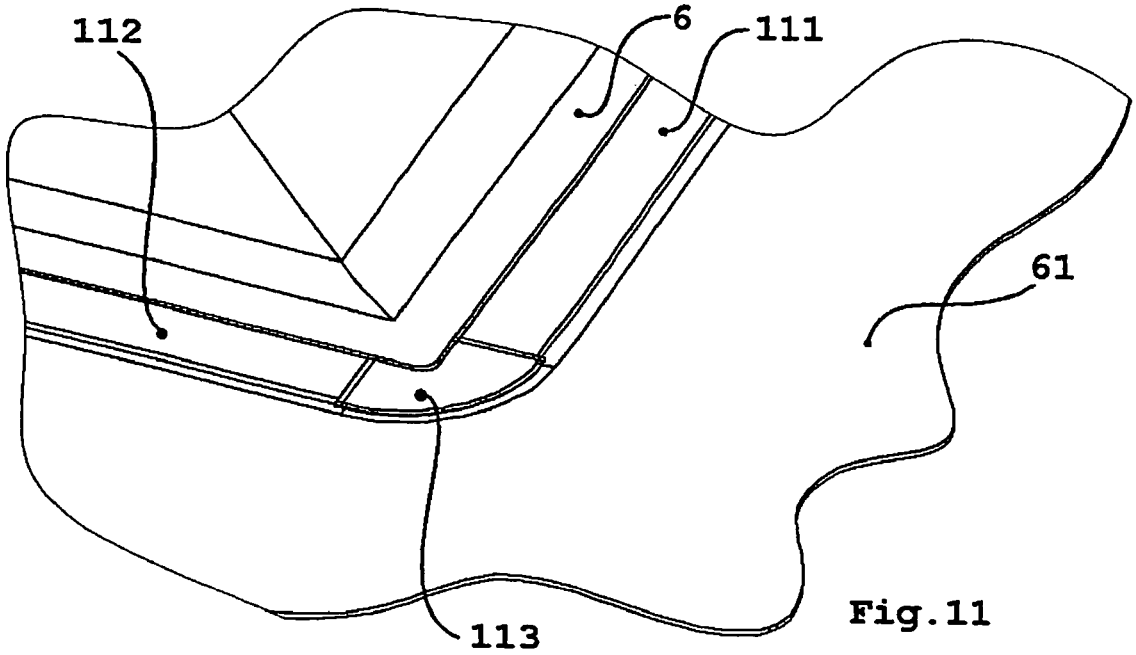
FIG. 11 is an enlarged fragmentary isometric view from above a front corner of one embodiment of the shower tray in a fully assembled state, from the same viewpoint as FIG. 6, showing the location of further components and surrounding flooring materials.

It will be beneficial now to describe the novel features of the present invention by referring to FIGS. 6, 7, 8, 9, 10, and 11 which show sequentially various details of the assembly and installation of an embodiment of an installation where the shower tray is recessed into the floor 71 so that the top external edge of the tray 72 is level with the top surface 73 of the floor 71. The shower tray is then retained by fixings 74 which may be woodscrews as shown in FIG. 7 or another suitable fixing for the underlying floor structure.

FIG. 6 shows a flexible floor covering (such as Altro™) 61, 62, 63 which has been installed and folded into the trough 8 to cover the trough sloping edge 42 and blend curve 43 with sections of the floor 62, 63 respectively. After the floor covering has been positioned onto the edge of the shower tray and located into the trough 8, a retaining bar 81 corresponding to each trough edge on the tray is pressed into position into the trough, with end seals 91 located on both ends of each of the bars. A plurality of retaining screws 84 are passed through corresponding holes in the retaining bar and are screwed into the threaded inserts 64 located within the shower tray to pull the retaining bar down into contact with the floor covering at a point in the vicinity of the tip of the bar, identified as 86.

Before all of the screws are tightened down, the corner block 92 is inserted between the retaining bar end caps 91.

As the plurality of fixing screws 84 are tightened down, the bar 81 contacts the base of the trough 8 at position 85, and pivots about 85 until it contacts the floor covering at 86. This action clamps the floor covering into the shower tray.

Preferably adhesively attached to the retaining bar 81 are two compressible seal elements 82, 83 which form waterproof seals between the retaining bar, the shower tray 1 and the floor covering 61. The head of the screw 84 may also form a seal with the retaining bar, and an optional seal washer (not shown) may be added below the screw head and retaining bar.

As the fixing screws (one shown 84 of a plurality) clamping down the corner block 92 are tightened, the corner block descends down into the gap between two retaining bar end seals 91 compressing them against the end of the retaining bar to achieve a fully waterproof seal clamp action in the corner of the shower tray and also extending along the full length of clamped floor covering which has been inserted into the shower tray trough 8.

To provide a cosmetic finish to the floor fixing clamp described before, cosmetic covers 111, 112 for each retaining bar and each corner 113 are clipped into position. The retaining bar covers 111, 112 are provided with tapered ended protruding fins 103 which clip into the corresponding tapered recess features 102 in the upper surface of the retaining bar. In the preferred embodiment the cosmetic cover 111, 112 may be made from extruded rigid PVCU or a similar material, and may be also provided with additional edge sealing details created by bi-extrusion of an elastomeric edge fin with the primary extrusion.

The retaining bar 81 may similarly be extruded aluminium or another suitably rigid material.

The cosmetic cover for the corner 113 is clipped into corresponding tapered locators 101 in the corner block 92.

The aforedescribed assembly sequence of one embodiment of the present invention when installed within the floor in a showering area presents a uniform level finished surface comprising the surrounding floor covering 61, the cosmetic cover 111, 112 and the shower tray screen seal surface 6.

Figure 12A:
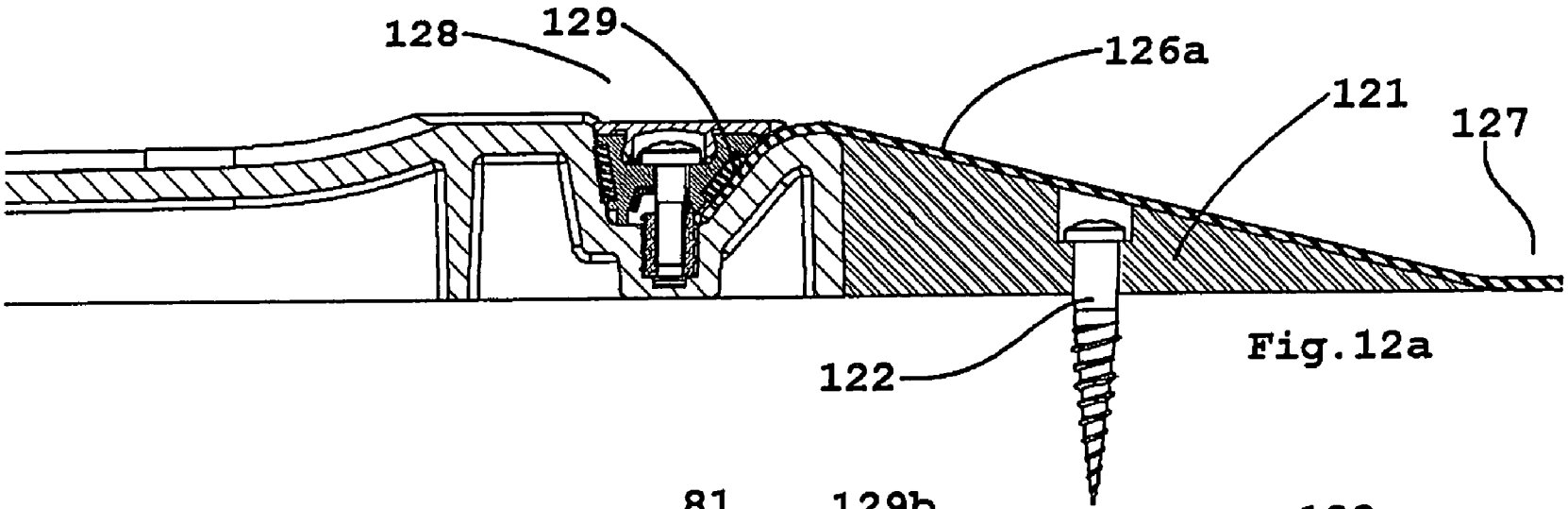
FIG. 12 is a series of two enlarged fragmentary sectional views (12*a*, 12*b*) each taken through a different embodiment of the shower tray and along two different parallel section planes perpendicular to the peripheral edges, the location of each is similar to that represented by FIG. 5*a*. Each of the views 12*a* and 12*b* presents an alternative surface mounted shower tray access ramp embodiment of the present invention.

The shower tray described above may also be installed on the surface of a showering area. FIG. 12*a* depicts such an installation where the floor covering 126*a* is laid over a triangular shaped timber or other rigid material profile 121 which provides a ramp from the general showering area 127 up to the shower tray area 128. Such a profile can be created during the installation by the installer, and may be sealed and fastened down to the floor with woodscrews 122 or similar fixings suited to the underlying floor structure. The cut edge of such a floor covering 129 is then clamped and sealed into the shower tray as described in the previous descriptions.

Figure 12B:
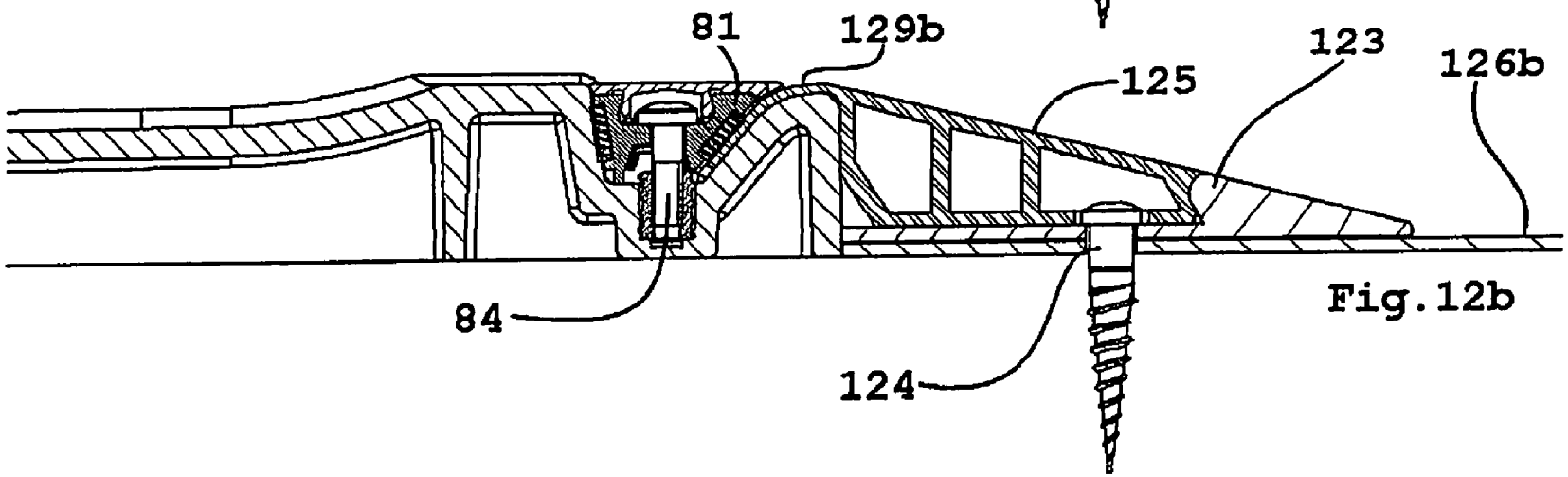

Yet another embodiment of the present invention where it is mounted on the surface of a showering area is shown in FIG. 12*b*. In this installation, the shower tray edge trough clamping mechanism described before is applied to retain a rigid preformed ramp device 125 which has a flexible profiled end 129*b* which is mutually mated with the outer ramp and blend side features of the trough. In this example of attachment of a pre-formed ramp, the thin edge of the ramp is shown mutually engaged into a mounting profile 123 which has been previously fitted to the existing floor 126*b* by screw fixing 124. The ramp 125 is initially located at the thin end into mounting profile 123 and then rotated about the mutual contact point between the mounting profile 123 and ramp 125 and lowered into the shower tray trough. The mutual contact point is so profiled as to retain the ramp firmly when it assumes the orientation indicated in the FIG. 12*b*. Optionally, the ramp 125 and profile 123 may be combined into a single component which is fastened to the existing floor by other means. The selective application of curable sealant mastic (not shown) to the component mutual contact points in FIG. 12*b* achieves water proof sealing along all edges of the installation external to the shower tray.

The height of the aforementioned ramp may be varied to suit the application in a particular showering installation, which may result in the ramp becoming effectively a horizontal thin flange with a sloping chamfered edge providing the transition from floor level to tray level. In this alternative embodiment of the present invention, the shower tray may be considered to replace a conventional 'low level' installation.

The shower tray described above can thus be installed into one of a plurality of different installation configurations equivalent to a wet floor former, a low level shower tray and a surface mounted shower tray. The particular configuration can be selected by the installer at the time of installation. Surrounding flooring material and/or an access ramp may be inserted and retained by the clamping and sealing device arrangement located within the tray periphery. The peripheral trough feature within the shower tray allows the installer a wide margin of error in the trimming of the floor covering material while still achieving an effective water seal and floor covering clamping mechanism.

The embodiments described above are given by way of example only and various modifications will be apparent to persons skilled in the art without departing from the scope of the invention as defined in the appended claims. For instance the method of connection to the adjoining flooring may differ from side to side of the shower tray, or the creation of a different shaped trough and internal components along the edges of the shower tray to achieve the same effective water seal and clamping mechanism.

What is claimed is:

1. A shower tray, comprising:

sloping upper surface facets that combine to direct water to a waste;

a flat or essentially flat surface surrounding the sloping upper facets;

a trough located in an upper surface of the tray, adjacent the flat or essentially flat surface, along one or more sides of the tray, and outer wall of the trough being inclined, an inclined outer wall being joined to a top outermost edge of the tray by a gently curved section; and a clamping mechanism comprising one or more elongate and/or corner clamping elements for clamping flexible floor covering material or a flexible edge of a ramp device in the trough, the clamping mechanism including means for fixing the clamping element in the trough.

2. The shower tray as claimed in 1, wherein the or each clamping element has one or more compressible edge seals.

3. The shower tray as claimed in claim 2, wherein the clamping element has two compressible edge seals, one for sealing against the tray along an inner wall of the trough and one for sealing against the flexible floor covering material or flexible edge of the ramp device along the outer wall of the trough.

4. The shower tray as claimed in claim 1, wherein the fixing means comprises a plurality of threaded fastening devices which engage with threaded inserts located within the base of the or each trough.

5. The shower tray as claimed in claim 1, further comprising corner clamping mechanisms for clamping in adjoining troughs at the ends of two elongate clamping elements.

6. The shower tray as claimed in claim 1, wherein sealing devices are provided at opposite ends of the or each elongate clamping element.

7. The shower tray as claimed in claim 1, wherein cosmetic covers are provided to cover the clamping element(s).

8. The shower tray as claimed in claim 7, wherein the cosmetic covers are snap fittable to the or each clamping element.

9. The shower tray as claimed in claim 1, wherein the inner wall of the or each trough is substantially, although not exactly, vertical.

10. The shower tray as claimed in claim 1, wherein the outer wall of the or each trough is inclined and wherein the or each elongate clamping element has a cross sectional shape which closely conforms to the cross sectional shape of the or each trough.

11. The shower tray as claimed in claim 1, wherein a plurality of fixing holes are provided externally or substantially externally of the or each trough for receiving screw threaded fixing devices for fixing the shower tray to or within a floor.

12. The shower tray as claimed in claim 11, wherein the fixing holes and any screw threaded fixing devices mounted therein are concealed, in use, by the flexible floor covering material or flexible edge of the ramp device clamped in the or each trough.

13. A shower tray assembly comprising the shower tray as claimed in claim 1 mounted within a hole in a floor and having the flexible floor covering material clamped in the or each trough by said clamping mechanism.

14. A shower tray assembly comprising the shower tray as claimed in claim 1 when fixed to an upper surface of a floor and having the flexible floor covering material running over the ramp alongside the or each trough and being clamped in the or each trough by said clamping mechanism.

15. A shower tray assembly comprising the shower tray as claimed in claim 1 fixed to an upper surface of a floor and having the ramp device alongside the or each trough, the ramp device having a flexible edge portion clamped in a respective trough by said clamping mechanism.

16. The shower tray as claimed in claim 1, wherein the trough includes an inner face that is substantially but not exactly vertical.

17. The shower tray as claimed in claim 16, wherein on an opposite side of the trough to the inner face is an outer sloping face and an outer blend curved face.

18. The shower tray as claimed in claim 17, wherein the inner face and the outer sloping face extend around edges of the shower tray so as to be blending in the trough in an approximately seamless manner.

19. The shower tray as claimed in claim 17, further comprising a flexible floor covering installed and folded into the trough to cover the outer sloping face and the outer blend curved face.

* * * * *